US005477934A

United States Patent [19]

Strand

[11] Patent Number: 5,477,934

[45] Date of Patent: Dec. 26, 1995

[54] LUBRICATING MECHANISM AND METHOD FOR A ROTARY CUTTER

[75] Inventor: Göran Strand, Sandviken, Sweden

[73] Assignee: Sandvik AB, Sandviken, Sweden

[21] Appl. No.: 309,480

[22] Filed: Sep. 21, 1994

[30] Foreign Application Priority Data

Sep. 22, 1993 [SE] Sweden ..... 9303083

[51] Int. Cl.[6] ..... E21B 10/24

[52] U.S. Cl. ..... 175/57; 175/227; 384/93

[58] Field of Search ..... 175/227, 228, 175/229, 371, 372, 57; 384/93; 184/105.1, 105.3, 14

[56] References Cited

U.S. PATENT DOCUMENTS

| | | | |
|---|---|---|---|
| Re. 34,167 | 1/1993 | Mattsson et al. | 175/57 |
| 1,487,319 | 3/1924 | Duda | 175/228 |
| 2,174,102 | 9/1939 | Catland | 175/228 X |
| 3,203,492 | 8/1965 | Lichte | 175/372 X |
| 3,303,898 | 2/1967 | Bercaru | 384/93 X |
| 3,419,093 | 12/1968 | Lichte et al. | 175/372 X |
| 3,866,695 | 2/1975 | Jackson | 175/228 |
| 4,509,607 | 4/1985 | Saxman et al. | 384/94 X |
| 5,363,930 | 11/1994 | Hern | 175/228 |

FOREIGN PATENT DOCUMENTS

| | | | |
|---|---|---|---|
| 2742019 | 3/1979 | Germany . | |
| 1221311 | 3/1986 | U.S.S.R. | 175/227 |
| 2027095 | 2/1980 | United Kingdom | 175/228 |

*Primary Examiner*—Hoang C. Dang
*Attorney, Agent, or Firm*—Burns, Doane, Swecker & Mathis

[57] ABSTRACT

A cutter mounted on a boring head includes a shaft and a roller body rotatably mounted thereon The greasing of bearings disposed between the roller body and shaft is achieved through an axial bore formed in the shaft and into which a filling plug is inserted. Grease is pumped through the filling plug and into channels in which the bearings are disposed. The filling plug is then removed, leaving the bore essentially grease-free. To prevent the escape of grease from the passage during a cutting operation, while accommodating thermal expansion of the grease, a grease retainer plug is secured in the passage. The retainer plug forms a space which communicates with the bearings for receiving thermally expanding grease. If the volume of expanded grease exceeds the volume of that space, the grease passes through a pressure relief valve and displaces a cover of the valve to create another space of gradually expanding volume for receiving the grease.

7 Claims, 3 Drawing Sheets

LUBRICATING MECHANISM AND METHOD FOR A ROTARY CUTTER

BACKGROUND OF THE INVENTION

The present invention relates to a cutter for a boring head, preferably a raise boring head (e.g., see U.S. Patent RE.34, 167 disclosing a raise boring head), and in particular to a lubrication mechanism of such a cutter.

A shaft of the cutter is rotatably mounted in a saddle secured to the raise boring head. Bearings provided between the shaft and an outer roller body of the cutter make it possible for the roller body to rotate relative to the shaft and for cutting elements on the roller body to perform a cutting operation. Seals disposed between the shaft and the roller body seal-in lubrication introduced into the bearings.

When cutters of the type mentioned above are working it is necessary that the bearings are embedded in a lubricant, preferably grease, i.e., the space between the shaft and the cutter is filled with grease. This is done in order to minimize friction when the roller body is rotated relative to the shaft. By having a low internal friction in the bearings, the life of the cutter is kept at an acceptable level. However, it has turned out that under very tough working conditions, i.e., when the cutter is subjected to a heavy load, much heat is generated by rotation of the roller body relative to the shaft and by friction generated as the cutter works the rock. Due to the heat generation the grease expands and the internal pressure of the cutter rises. Under such conditions, it occasionally happens that the internal pressure of the cutter reaches a level where the seals are not able to withstand the internal pressure, i.e., the seals collapse and the grease emerges from the bearings. It is readily understood that if the seals collapse, the cutter will rapidly breakdown.

From German Patent No. 27 42 019 a cutter for a tunnel boring machine is previously known, the cutter being equipped with pressure relief valves connected to certain ends of the internal grease passages. Other ends of the internal grease passages are equipped with nipples for introducing grease into the internal grease passages. The function of the pressure relief valves is to allow passage of excessive grease both when grease is primarily introduced into the interior of the cutter as well as when regreasing of the cutter is effected. However, if the cutter according to DE-PS 27 42 019 is subjected to heavy loads and consequently a thermal expansion of the grease takes place, the pressure will increase until the pressure relief valves open. Thus, it is absolutely necessary that the valves function properly to avoid damage primarily to the grease seals and subsequently to the bearings. It is well known that the working conditions of cutters are extremely tough and that a considerable amount of dirt/cuttings adhere to the cutter. Therefore, there is considerable risk of the pressure relief valves becoming clogged and consequently not opening at their nominal pressure.

SUMMARY OF THE INVENTION

The object of the present invention is to present a cutter that can be used under extremely tough working conditions, especially when heat is generated inside the cutter and the grease expands. The aim of the present invention is realized by a cutter that comprises a non-rotatable shaft defining a longitudinal axis, and a roller body mounted on the shaft for rotation relative thereto about the axis. The roller body carries cutting elements. Bearings are disposed in a channel formed between the shaft and roller body. The channel contains a lubricant. Seals are arranged between the shaft and roller body for resisting the escape of lubricant. A passage is formed in the shaft so as to communicate with the channel for accommodating the introduction of lubrication thereto. A device is provided for accommodating thermally expanding lubricant from the channel while preventing the escape of such thermally expanding lubricant from the passage. The device comprises a plug disposed in the passage. The plug has opposite ends and a space formed between those ends. The space communicates with the channel for receiving thermally expanding lubricant therefrom.

Preferably, the device further includes a cap movable within the passage relative to the plug to form therebetween a second space of expandable volume. The second space communicates with the first space for receiving thermally expanding lubricant therefrom which induces movement of the cap in a manner increasing the volume of the second space.

A pressure relief valve is preferably disposed between the first and second spaces. The cap isolates the relief valve from external debris.

The present invention also relates to the presence of the movable cap with or without the presence of the first space.

The present invention also relates to the plug per se.

An additional aspect of the invention involves a method of greasing bearings which are disposed in a cutter. The cutter comprises a stationary shaft and a roller body mounted on the shaft for rotation relative thereto about an axis. A filling plug is inserted into an axial bore of the shaft. Grease is forced through an axial feeding hole of the filling plug so that grease exits an outlet of the feeding hole and enters a bearing channel disposed between the shaft and the roller body between which the bearings are disposed. The filling plug is removed from the bore, leaving the bore generally grease-free. A grease retainer plug is then installed into the bore and locked in place.

BRIEF DESCRIPTION OF THE DRAWINGS

Below, an embodiment of the cutter according to the present invention is described, reference being made to the accompanying drawings, wherein.

DETAILED DESCRIPTION OF A PREFERRED EMBODIMENT OF THE INVENTION

Figure 1:
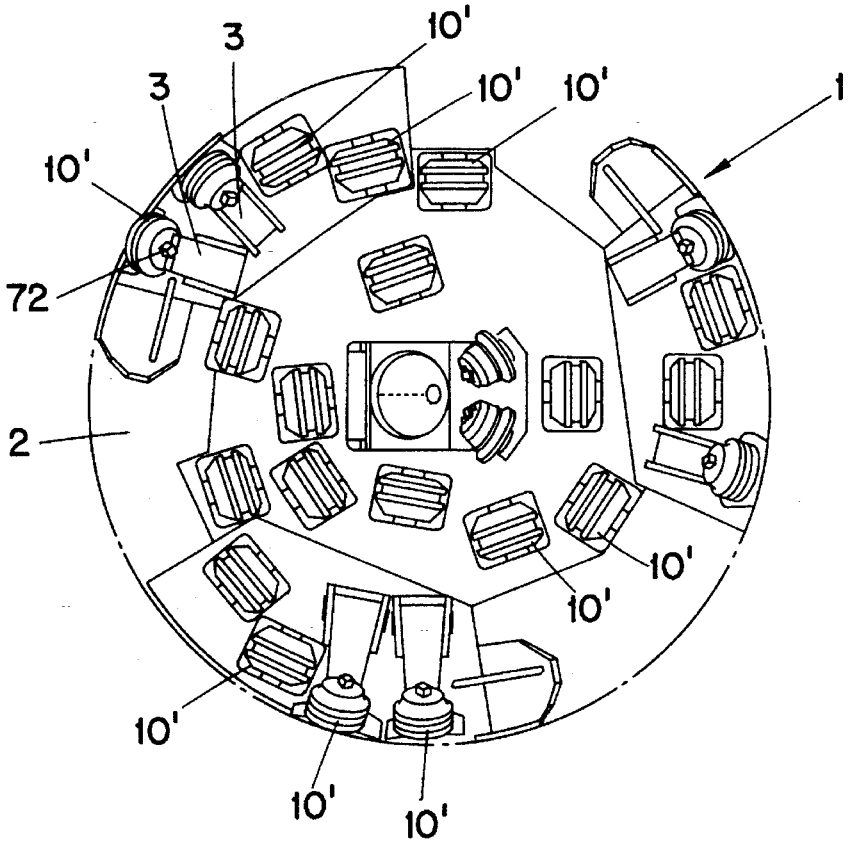
FIG. 1 (PRIOR ART)
FIG. 1 shows a plan view of a prior art raise boring head.
Figure 4:
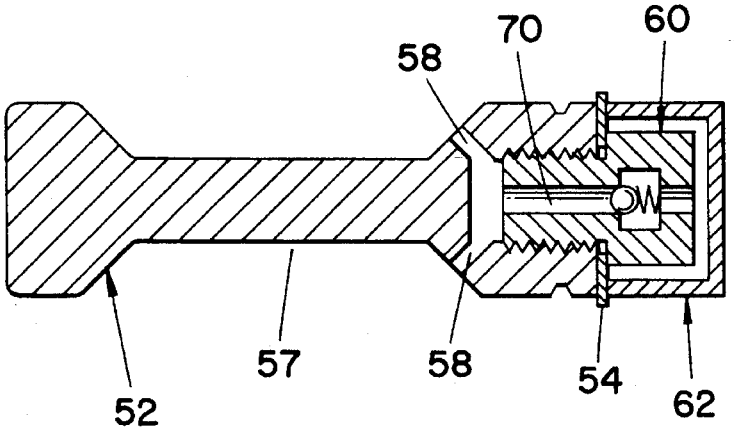
FIG. 4 shows a longitudinal section through a retainer used in FIG. 3.

Depicted in FIG. 1 is a conventional raise boring head 1 comprising a rotary carrier 2 on which is mounted a plurality of cutters 10'. Each cutter is mounted in a saddle comprised of two arms 3 disposed on opposite sides of the cutter. In accordance with the present invention the cutters 10' are in the form of cutters 10 depicted in FIGS. 2–4. Each cutter 10 includes a shaft 12 having a longitudinal center axis 14. The shaft 12 is mounted in the saddle, the saddle being secured to the body 2 of the boring head. (See U.S. Patent No. RE. 34,167 for a description of a conventional saddle and boring head, the disclosure of that patent having incorporated by reference herein.) A roller body 16 is rotatably mounted on the shaft 12 via two sets of bearings 18 and 20, respectively. The roller body carries cutting elements 16'. Bearing means 18 is received in a first circumferential channel or groove 22 formed in an outer periphery of the shaft 12, while bearing means 20 is received in a second circumferential channel or groove 24 formed in an inner periphery of the roller body or hub 16. The roller body 16 is locked axially relative to the shaft 12 by locking means 26, preferably including an annular row of balls 26 disposed in cooperating third and fourth circumferential channels or grooves 28 and 30, formed respectively in the shaft 12 and the roller body 16.

Between the axial ends of the roller body 16 and the shaft 12 the cutter 10 is provided with seal retainer means 32 supporting sealing means 33 that prevents grease from leaking out from the interior of the cutter 10. Both seal retainer means 32 are equipped with first relief holes 34 in which conical plugs 36 are mounted to prevent grease from leaking out through the holes 34. The function of the first relief holes 34 is explained more in detail below.

The cutter 10 is provided with an axial boring 38 that extends along axis 14 from one end of the shaft 12, i.e., in the disclosed embodiment from the end of the shaft 12 where the roller body has its smallest outer diameter. The axial boring 38 extends about halfway of the length of the shaft 12. Close to the inner end of the boring 38, a generally radial boring 40 extends from the axial boring 38 to the third groove 28. The boring 40 is used to install the balls 26' of the locking means 26. When the balls have been installed, a ball plug 42 and a spacer plug 44 are mounted in the boring 40. To insert grease into the cutter, a filling plug 46 is removably mounted in the axial boring 38 by a frictional slide fit. For access reasons the filling plug 46 extends out of the boring 38 and is provided with a grease nipple 47 and an internal axial feeding hole 49 that extends from the nipple 47 to the opposite end portion of the filling plug 46. A radially extending discharge hole 51 emanates from the feeding hole 49 and perforates the envelope surface of the filling plug 46.

The ball plug 42 is provided with two axially extending holes 48, 48' which are parallel to and offset from the longitudinal center axis of the ball plug 42, while the spacer plug 44 is provided with one axially extending central hole 50. The reason why the holes 48, 48' of the ball plug 42 are offset from the axis of plug 42 is to prevent the area of contact between the balls of the locking means 26 and the ball plug from blocking the entry of grease into the locking means 26. The channel 28 communicates with both of the channels 22 and 24, so that grease introduced into the channel 28 also travels to the bearings 18 and 20.

Figure 2:
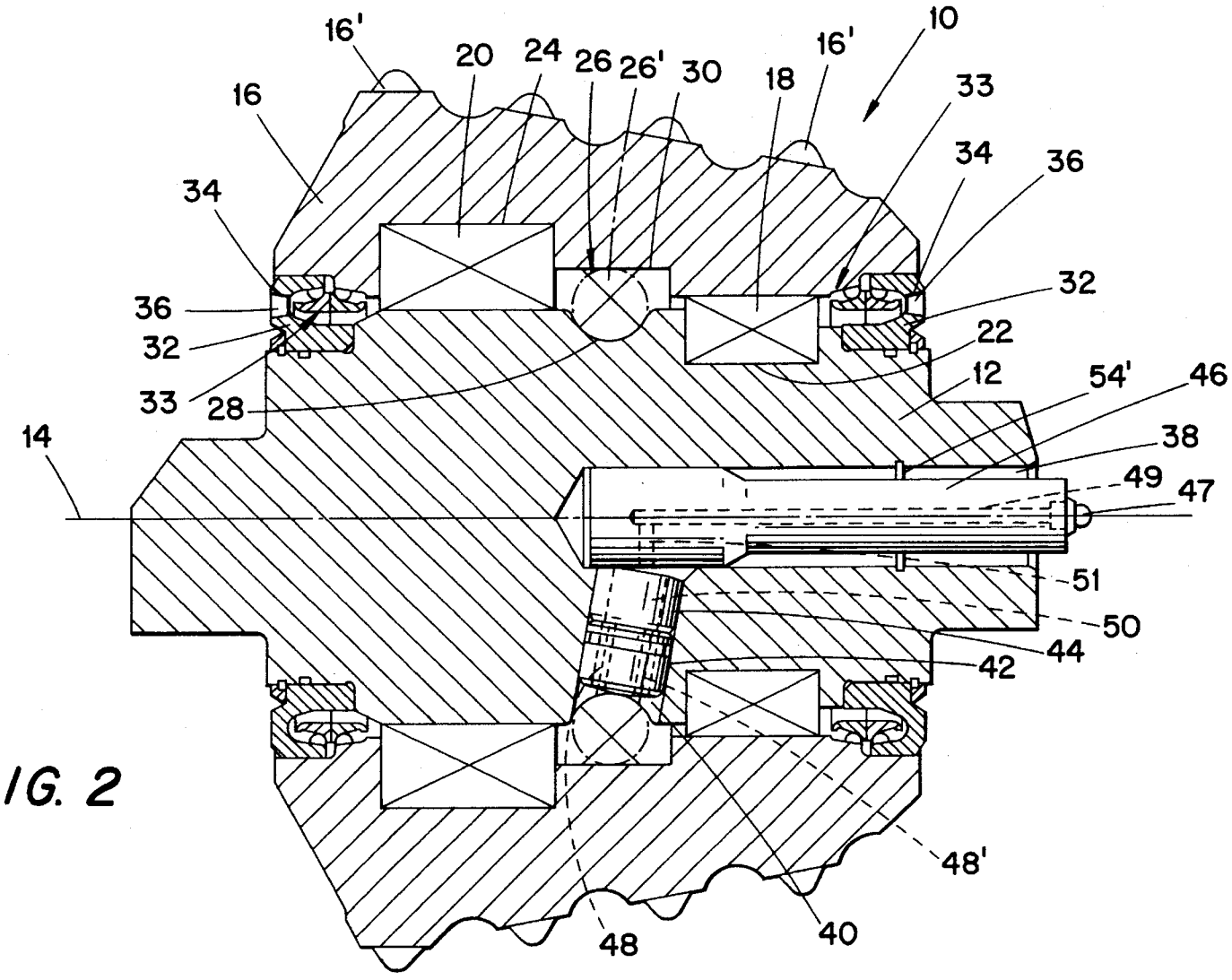
FIG. 2 shows a longitudinal section through a cutter when grease is introduced into the interior of the cutter.
Figure 3:
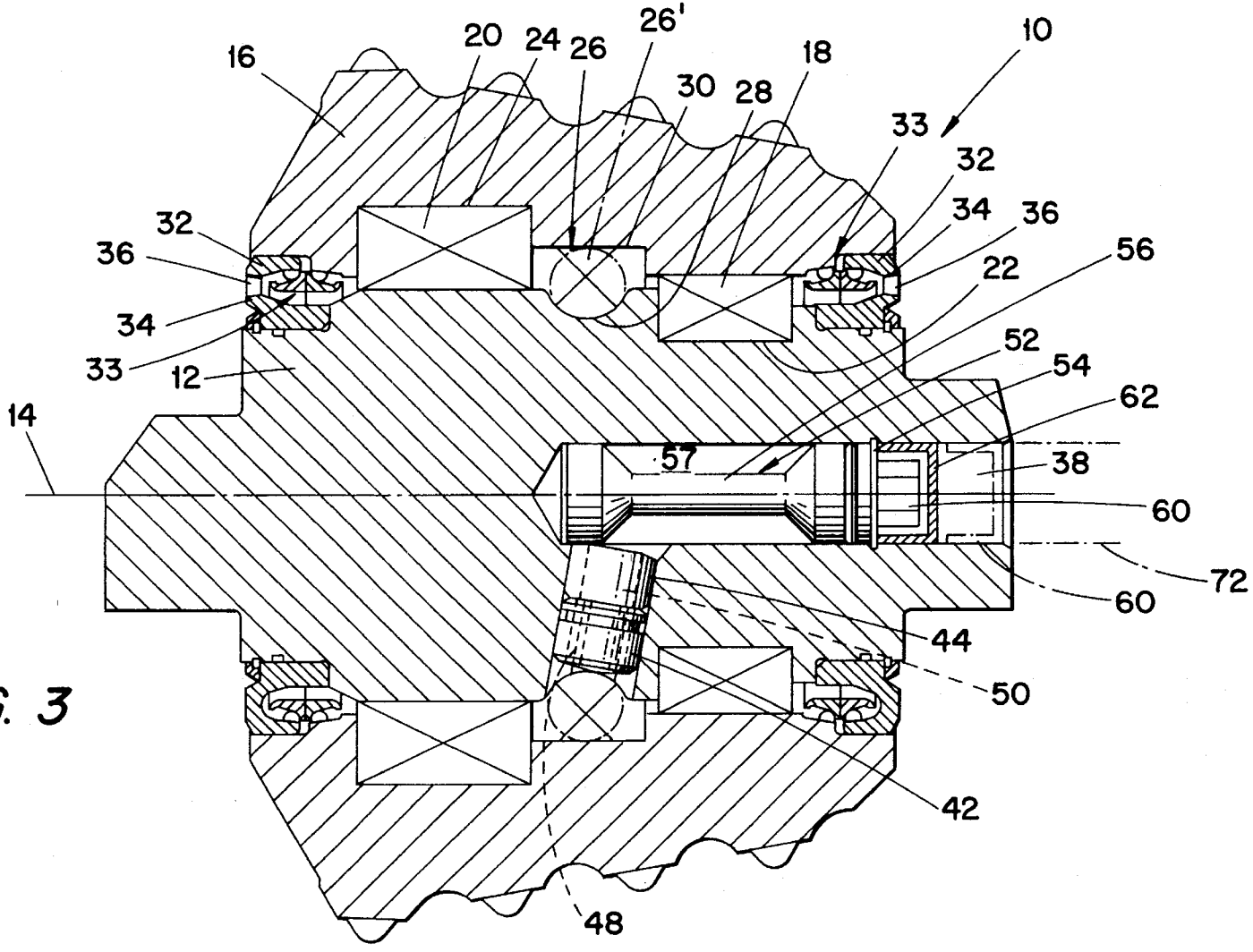
FIG. 3 shows a longitudinal section through the cutter according to FIG. 1 when the cutter is in a working condition.

In FIG. 2 the cutter 10 is shown in condition for being greased or regreased. A grease gun (not shown) is attached to the grease nipple 47 and grease is pumped into the cutter by the grease gun. The first relief holes 34 are used to control the level of the grease inside the cutter 10. That is, excess grease is forced through the holes 34. The conical plugs 36 are mounted in the first relief holes 34 when the greasing or regreasing is completed.

The filling plug 46 is then removed, leaving the bore 38 essentially grease-free, and is replaced by a retainer plug 52 (see FIGS. 3 and 4) that has a shorter length compared to the filling plug 46. The retainer plug is also mounted via frictional slide fit. However, the retainer plug 52 is secured against outward axial displacement by a snap ring 54 which fits in a recess 54' formed in the boring 38 (see FIG. 2). The retainer plug 52 has an intermediate portion 56 with reduced diameter and consequently a circumferential expansion space 57 is provided between the reduced diameter portion 56 and the wall of the boring 38. At its front end the retainer plug 52 bears against the bottom of the radial boring 38. At its rear end the retainer plug 52 is provided with second relief holes 58 that communicate with a center passage 70 of a conventional pressure relief valve 60 of any suitable type which is threadedly connected in a rear end of the retainer plug. A cap 62 covers the free end of the pressure relief valve 60 in order to prevent the valve 60 from being clogged by cuttings/dirt. The cap 62 is mounted with a frictional slide fit in the boring 38.

The cutter 10 according to the invention functions in the following way. When a cutter 10 is set under working conditions it rotates and is subjected to heavy loads. This means that due to friction heat is generated in the bearing means 18, 20 and the locking means 26 of the cutter 10 and consequently also the grease is heated. When the grease is heated it expands and since the seal retainers 32 prevent grease from leaking out between the roller body 16 and the shaft 12, the grease enters into the expansion space 57. If the grease expands to such an extent that the space 57 becomes completely filled with grease then there is a possibility for the grease to travel through the openings 58 and the pressure relief valve 60. However, under normal conditions the expansion space 57 should be sufficient to accommodate the expansion of the grease.

In case grease travels through the pressure relief valve 60 the cap 62 will be displaced outwardly towards the opening of the boring 38, thereby expanding the volume of the space formed between the valve 60 and the cap 62. When the cap 62 reaches the opening, further displacement is prevented due to the presence of a conventional bolt 72 securing the shaft 12 in the saddle. (See the broken line position of the cap 62 shown in FIG. 3.) This arrangement will permit thermal expansion of the grease while effectively preventing cuttings/dirt from clogging the pressure relief valve 60. It will be appreciated that any other suitable means could be provided for limiting the outward sliding movement of the cap 62.

The embodiment described above relates to a cutter for a raise boring head although it is also possible to practice the invention in connection with cutters/discs for tunnel boring heads. It is also possible within the scope of the present invention to use bearing means including tapered roller bearings. In such a case there is normally no need for axial locking means since the tapered roller bearings give support both in radial and axial directions. Thus, the retainer plug 52 would retain only grease since the spacer plug 44 could be omitted.

Although present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A cutter comprising:

a non-rotatable shaft defining a longitudinal axis;

a roller body mounted on said shaft for rotation relative thereto about said axis, said roller body carrying cutting elements;

bearings disposed in a channel formed between said shaft and roller body, said channel containing a lubricant which is thermally expandable during rotation of said roller body;

seals arranged between said shaft and roller body for resisting the escape of lubricant;

a passage formed in said shaft and communicating with said channel, a portion of said passage being free of lubricant; and a device for accommodating thermally expanding lubricant from said channel while preventing the escape of such thermally expanding lubricant from said passage, said device disposed in said portion of said passage and comprising first and second members disposed in said passage, said first member disposed closer to said channel, and said second member disposed farther from said channel and closer to an outer end of said passage, said first and second members being relatively movable away from one another in said passage to form an expandable-volume first space therebetween, said first member defining an empty second space which is essentially free of lubricant and which communicates with said channel for receiving thermally expanding lubricant therefrom, said second space communicating with said first space so that said first space is expandable by thermally expanding lubricant which has filled said second space, said second member blocking the escape of lubricant from said outer end of said passage.

2. A cutter according to claim 1, wherein said second member is slidable away from said first member in said passage.

3. A cutter according to claim 2, wherein said device further includes a pressure relief valve disposed upstream of said second member with reference to a direction of flow of thermally expanding lubricant.

4. A cutter according to claim 1, wherein said second member is movable within a section of said passage extending along said axis.

5. A device insertable into a passage of a cutter for accommodating thermally expanding lubricant while preventing the escape of thermally expanding lubricant from the passage, said device comprising a plug having first and second longitudinally spaced ends fixedly interconnected to prevent relative movement therebetween, said plug including an intermediate portion disposed between said ends and being of reduced diameter for forming a lubricant-receiving space, a pressure relief valve disposed in said plug adjacent said second end and communicating with said space, said relief valve including a yieldable element admitting a flow of thermally expanding lubricant from said space to an opening formed in said second end, and a cap disposed opposite said opening and being freely slidable away from said plug.

6. A method of greasing bearings disposed in a cutter, said cutter comprising a stationary shaft and a roller body mounted on said shaft for rotation relative thereto about an axis, said method comprising the steps of:

inserting a filling plug into a bore of said shaft, said plug including a leading end initially inserted into said bore;

forcing grease through an axial portion of a feeding hole of said filling plug so that said grease exits a laterally extending outlet of said feeding hole spaced from said leading end and enters a bearing channel disposed between said shaft and roller body and in which said bearings are disposed;

removing said filling plug from said bore, leaving said bore generally grease-free; and installing a grease retainer plug into said bore and locking said retainer plug in place in said bore.

7. A method according to claim 6, wherein said inserting step further comprises inserting said filling plug into said bore extending along said axis of rotation of said shaft.

* * * * *